US006385856B1

(12) United States Patent
Godin

(10) Patent No.: US 6,385,856 B1
(45) Date of Patent: May 14, 2002

(54) PIPE-BENDING ALIGNMENT DEVICE

(76) Inventor: Jeffrey L. Godin, 10 Pleasant Hill Dr., Waterville, ME (US) 04901

( * ) Notice: Subject to any disclaimer, the term of this patent is extended or adjusted under 35 U.S.C. 154(b) by 0 days.

(21) Appl. No.: 09/317,911

(22) Filed: May 24, 1999

(51) Int. Cl.[7] ..... G01B 21/00; G01C 9/00

(52) U.S. Cl. ..... 33/343; 33/529; 33/533; 33/534

(58) Field of Search ..... 33/529, 533, 534, 33/343, 370, 371, 372, 373, 391, 397, 366.24

(56) References Cited

U.S. PATENT DOCUMENTS

| | | | | | |
|---|---|---|---|---|---|
| 2,824,381 | A | | 2/1958 | Traupmann | |
| 2,932,225 | A | * | 4/1960 | Gardner | 72/459 |
| 3,060,587 | A | * | 10/1962 | Picken | 33/343 |
| 4,009,602 | A | * | 3/1977 | Linquist | 33/529 |
| 4,394,799 | A | * | 7/1983 | Moree et al. | 33/343 |
| 4,622,837 | A | | 11/1986 | Bergman | |
| 4,785,650 | A | * | 11/1988 | Lusty | 33/529 |
| 4,807,370 | A | * | 2/1989 | Trimble | 33/529 |
| 5,154,000 | A | | 10/1992 | Mahoney et al. | |
| 5,163,229 | A | * | 11/1992 | Cantone | 33/227 |
| 5,167,075 | A | * | 12/1992 | Weldy et al. | 33/343 |
| 5,666,736 | A | * | 9/1997 | Wen | 33/275 R |
| 5,839,200 | A | * | 11/1998 | Decesare | 33/381 |
| 5,977,922 | A | * | 11/1999 | Hemmingsen, II | 248/544 |
| 6,052,911 | A | * | 4/2000 | Davis | 33/286 |

* cited by examiner

*Primary Examiner*—Diego Gutierrez
*Assistant Examiner*—Yaritza Guadalupe
(74) *Attorney, Agent, or Firm*—Pierce Atwood

(57) ABSTRACT

An economical, compact guide for introducing multiple bends in one or more planes in a pipe, conduit, or other tube-like item. The guide has a gauge section rotatably attached to a mounting section and is affixable by means of a non-deforming clamp to the end of a pipe segment to be bent. The gauge section has a bend-angle gauge and a bend-plane level. The bend-angle gauge is a plumb arm mounted so as to measure and indicate the bending of a pipe to any degree of bend. The bend-plane guide is a 360° level mounted on an upper face of the plumb arm. Multiple bends are made in the pipe segment without removing or re-aligning the guide. This ensures that the initial reference position is maintained throughout the bending process and ensures that all bends are in the proper bend-plane, thus avoiding "dogging" between successive bends. Multiple successive bend-planes also may be established without removing or re-aligning the guide on the pipe, by rotating the gauge section of the guide relative to the mounting section by the magnitude of the desired out-of-plane angle.

12 Claims, 7 Drawing Sheets

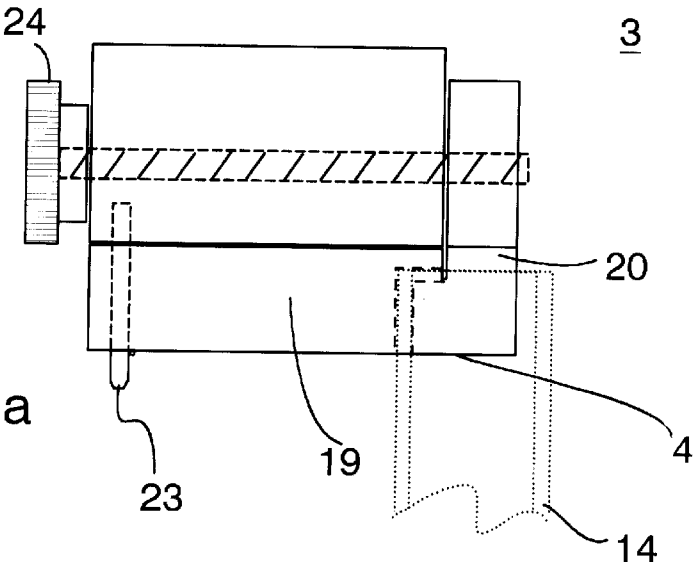
FIG 3a
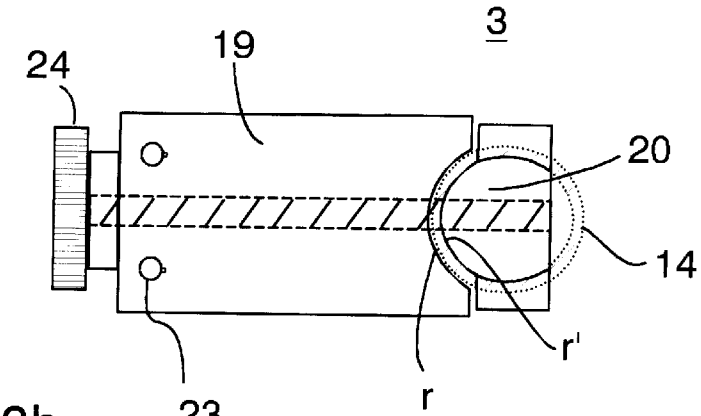
FIG 3b
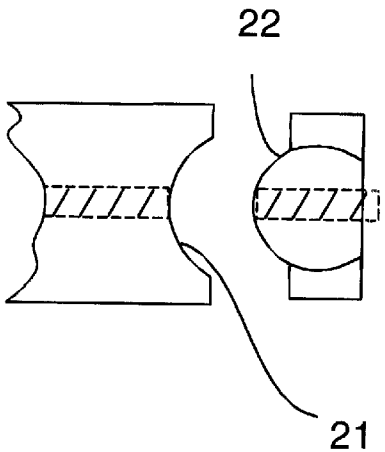

PIPE-BENDING ALIGNMENT DEVICE

BACKGROUND OF THE INVENTION

1. Field of Invention

The present invention relates to the field of fabrication and construction. In particular, the invention relates to the fields of plumbing and wiring. More particularly, the invention relates to the installation of pipe, conduit, and other pipe-like material, such as hydraulic and pneumatic tubing. Still more particularly, the invention relates to the accurate bending, for shaping and routing, of pipe, conduit, and other tube-like material in multiple planes.

2. Prior Art

In many fields, it is frequently necessary to bend pipe, conduit, and other tube-like items (hereinafter "pipe"). The need arises, for example, in the installation of electrical equipment, plumbing systems, and, generally, in construction work. Typically, a single pipe will have to be bent several times. There are two components of the bending process that must be carefully controlled when introducing multiple bends in a pipe: the bend-angle and the bend-plane. Thus, the pipe-bender must be able to accurately measure and control the bend-angle of each bend and the bend-plane, to ensure, for example, that the latest bend is in the desired plane.

It is useful to define a few terms. Reference has been made to a "bend-plane." In order to see what is meant, consider a pipe with no bends in it. There is no plane defined at this point by the pipe regardless of how it is oriented. However, once a single bend introduced in the pipe (resulting in two pipe segments) a bend-plane is defined; it is the plane in which both segments lie (or, more carefully stated, the plane defined by the centerlines of the two segments). This bend-plane of course is only defined with respect to the pipe; its orientation in space is arbitrary and is determined by how the pipe is oriented. When the pipe is laid on a horizontal table, the table will be parallel to the bend-plane; the bend-plane is horizontal. Similarly, if the two-segment pipe is pressed flat against a vertical wall, the bend-plane is vertical.

It can be seen that one does not choose the first bend-plane; it will be defined by the two segments resulting from the bend. However, once that first bend is introduced, a bend-plane has been defined, and a subsequent bend in the pipe is either in that plane or out of it. The second bend will introduce a third segment in the pipe and the potential for two bend-planes, one—the first bend-plane—defined by the first and second segment, the other—the second bend-plane—by the second and third segment. Commonly, depending on the use to which the pipe is to be put, it will be desired that the first bend-plane and the second bend-plane are coincident, or, alternately stated, that the second bend-plane lie in the first bend-plane. This would be the case, for example, when the two bends are put in simply to cause an off-set pipe configuration, where all three resulting segments lie in the same plane, and the first and third segments are parallel to one another. Alternatively, it may necessary that the third segment be "out of" the first bend-plane, and that it be out of that plane by a specific angle, and a specific direction.

Although it is important to be able to determine the angle that a pipe segment resulting from a particular bend makes with a particular bend-plane, the most common use for a bend-guide device is to ensure that the segment resulting from a bend is in the bend-plane defined by the previous bend placed in the pipe. If a segment that is supposed to lie in that previously defined bend-plane does not in fact lie in it, one says that it is "dogged" or a "dogged bend" (from "dogleg"). The difficulty in making accurate multiple bends can be viewed simply in terms of making a second bend in a pipe, that is, in introducing a second bend after a first bend-plane has been defined. For example, inadvertently twisting the pipe or shifting the reference plane between the first and second bends will result in the undesired dogging. Devices for guiding pipe bending so as to control the angle-of-bend and for ensuring that the latest-formed bend segment lies in the previously defined bend-plane are therefore in great demand, as can be seen by the prior art. Since a bend-plane is defined by two adjacent pipe segments "created" by a bend, it is useful to also characterize a bend-plane as being defined by the bend (as an alternative to saying that the plane is defined by the two pipe segments that meet at the bend in question).

Simple devices including levels, plumbs, and protractors by themselves, and more elaborate guiding devices employing levels, plumbs, and protractors in combination, have long been employed to introduce bends of pre-determined angles in pipe and then to verify the angle-of-bend and to confirm that the resultant pipe configuration has the desired planarity. Some of these devices attach to the tool being used to bend the pipe and indicate the degree of bend as the pipe-bending tool operates. See, for example, Bergman (U.S. Pat. No. 4,622,837; issued 1986), which teaches the use of a spirit level built into the pipe-bending tool itself to indicate the angle of rotation of the tool from some pre-selected reference direction and, thus, the "instantaneous" angle of bend given to the pipe being bent on the tool. Devices of this type have a serious drawback in that they have no means of indicating or tracking a bend-plane, thereby making it difficult to ensure that a bend being introduced in a pipe lies in the plane defined by a prior bend. In devices like that of Bergman, one makes a subsequent bend in the pipe by sliding the pipe so that the part of the pipe in contact with the pipe-bending tool shifts from the first bend to the position where one desires to place the next bend. During this movement, it is easy to unknowingly twist the pipe enough to get dogging in the next bend, i.e., to cause the next bend segment to jut up out of the plane defined by the first bend. A similar pitfall exists with those guide-equipped tool-bending tools that are removed from the site of a first bend and re-attached to the pipe at the site of the desired second bend.

Traupmann (U.S. Pat. No. 2,824,381; issued 1958) teaches a bend-guide device that, instead of being integrated into the bending tool, is clamped around a segment of a pipe that is to be bent. It appears that the primary function of the Traubmann device is to introduce in-plane offsets into a pipe, the operation by which two bends, of equal angle and opposite sense, are introduced into a pipe so to produce three new pipe segments: a first segment, a second (middle) segment, and a third segment such that all three segments are in the same plane and the first and second segments are parallel to one another. In order to accomplish this task, the guide device of Traubmann must first be mounted on what is to become the middle segment of the offset and then, after the first bend has been introduced, the device must be moved to what is to be the third segment. A major disadvantage of the Traubmann device is that it can indicate direction only for the horizontal projection of the longitudinal axis of the pipe segment to which the device is attached. This means that re-clamping the device for making the second bend can introduce a twist that results in the third segment being out of the plane defined by the first bend. Of course, this problem arises with any bend being guided by the Traubmann device that is supposed to be in a defined plane; this device does not provide any way of ensuring that the bend is indeed in the desired plane. It is also noted that simply having to move and reclamp the Traubmann device is time-consuming. It means that for multiple bends not only does one have to move the pipe-bending tool along the pipe (common to all pipe-bending operations), but one also has to repeatedly reposition the guide device, which in any event does not provide guidance for ensuring that the new bend-plane is coincident with an earlier one.

There do exist recent prior-art devices that attempt to address the need for making several co-planar pipe bends and in particular to ensure that a particular bend is in the same plane as an earlier bend. Weldy et al. (U.S. Pat. No. 5,176,075; issued 1992) discloses such a pipe-bending guide clippable to the open end of a pipe's end segment. In use, the guide of Weldy et al. is aligned with the longitudinal axis of the end segment of the pipe to be bent, and remains in place throughout the bending operation so as to indicate the relative angle of bend of each of several successive bends. To achieve this, the Weldy et al. device has a spirit level set into a distal section that is pivotable with respect to the proximal section (that section clipped directly to the pipe), pivotable about an axis that is perpendicular to the longitudinal axis of the device. Because of angular markings on the pivot mount, one can pivot that distal section through a selected angle, say −22.5°. Then one bends the pipe in such a way that the spirit level in that distal section again has its bubble in the center, thus indicating a +22.5° bend in the pipe. The device of Weldy et al. addresses the "co-planarity" issue through a spirit level mounted fixedly in the proximal section, the axis of this spirit level being perpendicular to the longitudinal axis of the proximal section of the device. This means that this spirit level is also perpendicular to the axis of the pipe segment to which the device is clipped. Before making the first bend, one ensures—either by rotating the device with respect to the pipe on which it is mounted or by rotating the pipe—that the bubble in this spirit level is centered. One ensures further that this bubble remains centered as the first bend is introduced. The device is not moved between bends. Thus, in setting up the next bend and before actually executing it, one ensures that the bubble in this "perpendicular" spirit level is again centered. It is by this means that the device of Weldy et al. seeks to establish co-planarity between the two bends, and hence for a series of multiple bends. Although this does help achieve this goal, the Weldy et al. device is limited to bends in the same plane. It does not address the need that often arises wherein a bend is to be out of a plane by a set angle. Furthermore, because of the nature of the means by which it is attached to the pipe, it can inadvertently be "cocked" by a few degrees, i.e., as attached to the pipe, its longitudinal axis may not be exactly parallel to the pipe axis, a violation of the condition assumed by the device. (It is noted in passing that even if a means existed for rotating the "perpendicular" spirit level by a fixed number of degrees about the longitudinal axis of the pipe, so that rotation of the pipe would set the workpiece up to introduce a desired out-of-plane bend, the modified Weldy et al. device would be incapable of introducing a bend of a pre-selected angle. The reason for this is that with the workpiece set up as described, the axis by which distal end is pivoted—in order to select a bend angle—would not be perpendicular to the next bend plane.)

Mahoney et al. (U.S. Pat. No. 5,154,000; issued 1992) also teaches a device for use in introducing multiple, co-planar bends in a pipe. The device attaches to the end of a pipe segment by means of set screws and may remain in place during several successive bends of the pipe. The Mahoney et al. device uses as a bend-indicator an angle-indicating section having either a spirit level in a housing that is rotatable along the longitudinal axis of the device and marked around its perimeter with a degree scale, or a freely rotating pendulum or plumb set in a housing marked with a degree scale as a means of measuring a bend in the vertical direction (similar to that of the Traupmann device). To address the dogging problem, the Mahoney et al. device contains an "anti-dog" section that operates in much the same way as the "perpendicular" spirit level of the Weldy et al device. The Mahoney et al. device has the same deficiencies as the Weldy et al. device, namely, that it cannot be used to deliberately introduce a dogging angle and it has the propensity to be misaligned when first placed on the pipe segment. In addition, it appears that the set screws of Mahoney et al. may damage the pipe end.

In summary none of the prior-art devices meet the needs of the craftsperson who needs to (1) introduce a number of co-planar bends in a pipe and/or (2) introduce a bend in a pipe that is out of a previously defined plane by a predetermined angle. Devices such as the one disclosed by Bergman and similar devices that attach to the bending-tool itself do not address at all the problem of ensuring co-planar multiple bends. The devices of Traupmann and Weldy et al. address the anti-dogging problem, but are not able to introduce a specific dogging angle into a bend. The Mahoney et al. device also has the disadvantage of using a two-point location as the mounting means, rather than full-service location. Particularly with larger diameter pipe, such as 6" pipe, the Mahoney et al. device could introduce an angular error resulting from a cocked mounting of the device at the outset (before bending is commenced). The angular error would be carried forward through all subsequent bends, thus introducing multiple, unintended out-of-plane bends. The Weldy et al. device may also result in a misalignment of the longitudinal axis of the device with the longitudinal axis of the pipe to be bent, as the mounting is a flat-surfaced clamp attaching to a curved pipe wall. Also, the devices of Traupmann and Mahoney et al may damage the pipe to which they attach because they use set screws or other fastening means to mount the device on the pipe.

Therefore, what is needed is a guide for bending pipe that will accurately measure and indicate bend-angles and bend-planes. What is further needed is a such a device that can be secured to the pipe just once at the beginning of the bending operation and not need to be repositioned, regardless of the number of bends and bend-planes to be introduced to a single pipe. What is also needed is such a device the mounting of which on a pipe does not deform the pipe. What is still further needed for efficiency and economy is such a device that has few parts, especially few moving and movable parts.

SUMMARY OF THE INVENTION

It is therefore an object of the present invention to provide a pipe-bending guide that will indicate and measure bend angles and enable an operator to control the bend-plane. It is a further object of the present invention to provide such a device that can be secured in position once on a pipe with no need for repositioning or re-aligning, regardless of the number of bends and bend-planes to be given to a single pipe. It is also an object of the present invention to provide such a device the mounting of which on a pipe segment does not deform or damage the pipe. It is a still further object of the present invention to provide an efficient and economical device by incorporating few parts, especially few moving and movable parts.

The device of the present invention is a multiple-bend-angle-and-multiple-bend-plane-guide for use in the bending of pipe. In comparison with the prior-art devices, the device is relatively small and compact. Furthermore, it is inexpensive to manufacture, consisting of relatively few parts. Yet further, the present invention brings to the field of pipe bending the added ability to control the bend-plane in which the angle is introduced. In particular, the device of the present invention enables a bend-tool operator to accurately gauge multiple bends in one or more bend-planes, and to do so without the need to remove and reinstall the guide between bends.

The device incorporates a gauge section ratchet-rotatably attached to a mounting section that clamps onto the end of the pipe to be bent. The mounting section includes a pair of curved jaws that are sized to conform to the respective curvatures of the inner and outer surfaces of the pipe. In addition, the mounting section is provided with a means to tighten the jaws against the pipe wall. The use of such jaws prevents any deformation of the end of the pipe to which the device is attached and, more particularly, ensures that the device is properly and securely located so that the longitudinal axis of the device is aligned parallel to the longitudinal axis of the pipe segment to which the guide is attached.

The gauge section of the device has a bend-plane level and a bend-angle gauge. The bend-angle gauge is a plumb arm depending from a forked plumb mount at a free end of the guide. A degree-indicating scale is mounted or marked on the sides of the forked plumb mount. The plumb arm is free to rotate 360° about an axis that runs perpendicular to the longitudinal device axis in the horizontal plane. In the Preferred Embodiment, the bend angle is indicated by a pointer that is fixedly attached to each end of the plumb mount so as to rotate with the plumb arm and point to a marking on a degree scale marked or mounted on the outer sides of the plumb mounting. A desired bend is introduced into the pipe segment by noting the initial reference position indicated by this pointer and then bending the pipe segment until the pointer indicates the desired degree of bend from the reference position. Other means of indicating the bend-angle may also be used. The bend-plane level is a 360° spirit level that is mounted on a flat-faced upper end of the plumb arm. Proper alignment of the pipe to a level condition as indicated on the bend-plane level, before the initial bend and with each subsequent bend, and without ever realigning the mount section on the pipe, will ensure that the pipe is bent accurately in the desired bend-plane without "dogging" the bend. To bend the pipe in a different bend-plane, the gauge section, while the device is still mounted on the pipe segment, is rotated relative to the mounting section through an angle equal to the desired "out-of-plane angle" and the pipe manipulated (so that the end-segment is rotated) until the bend-plane level again indicates a level condition. The pipe segment is then bent as previously described. It is noted that in contrast to the prior-art devices of Weldy et al. and Mahoney, the device of the present invention contains the bend-angle indicator in the same segment as the bend-plane indicator.

The means for mounting the device of the present invention on the pipe both minimizes the angular error resulting from skewed location of the guide and also prevents damage to the end of the pipe. Because of the nature of the device the bend-tool operator is able to observe the indicators and gauges from a single operating position and to use the guide without assistance and with minimum movement and strain of the operator's body. Furthermore, incorporating the 360° bend-plane level and the plumb arm into a single component reduces the complexity of the device, making it less costly to produce.

BRIEF DESCRIPTION OF THE DRAWINGS

FIG. 3*a* is a view of the mounting section of the guide device of the present invention, shown with its longitudinal axis vertical; the gauge section (not shown) would attach at the top of the mounting section as shown here. Note that not all the invisible lines are shown. The dotted lines indicate a pipe to which the mounting section is attached.

FIG. 3*b* is an end view of the same mounting section.

PREFERRED EMBODIMENT OF THE INVENTION

Figure 1:
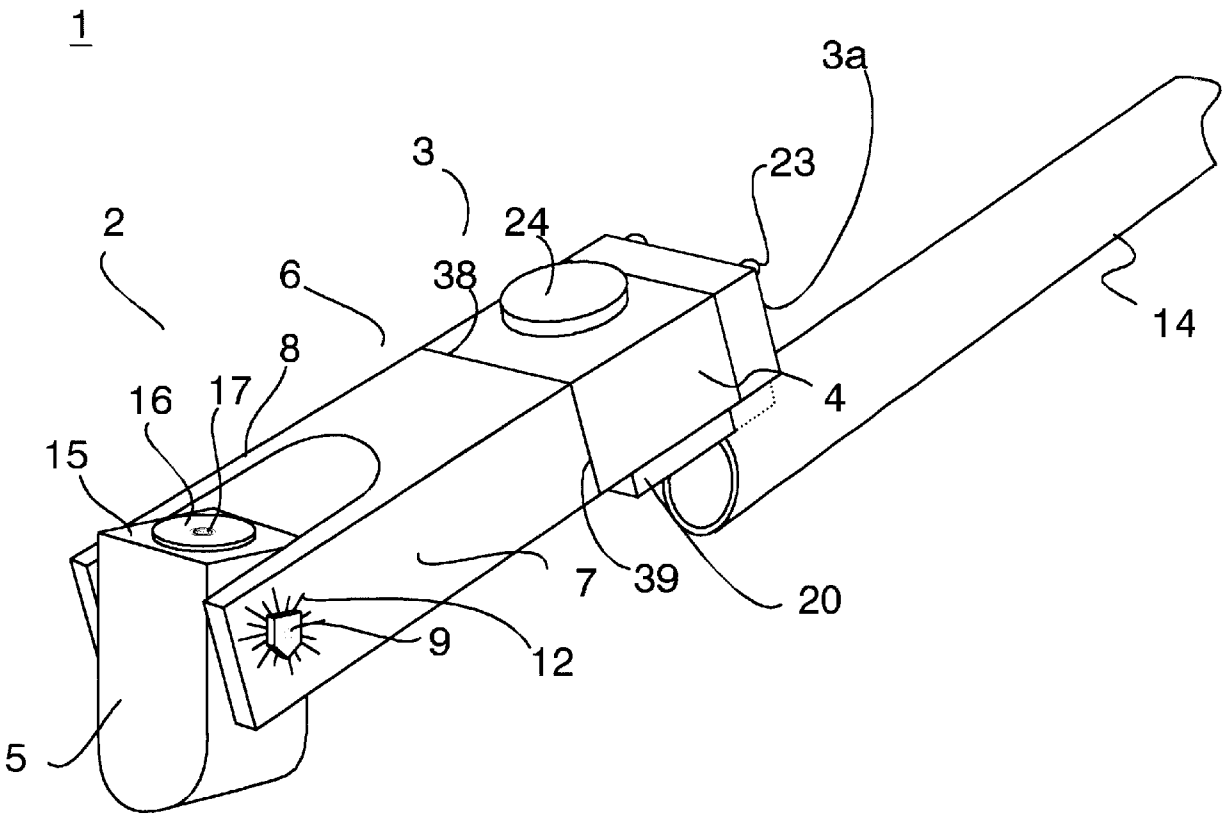
FIG. 1 is a perspective view of the Preferred Embodiment of the device of the present invention, showing the gauge section and the mounting section, with the mounting section attached to the end segment of a pipe to be bent.
Figure 4A:
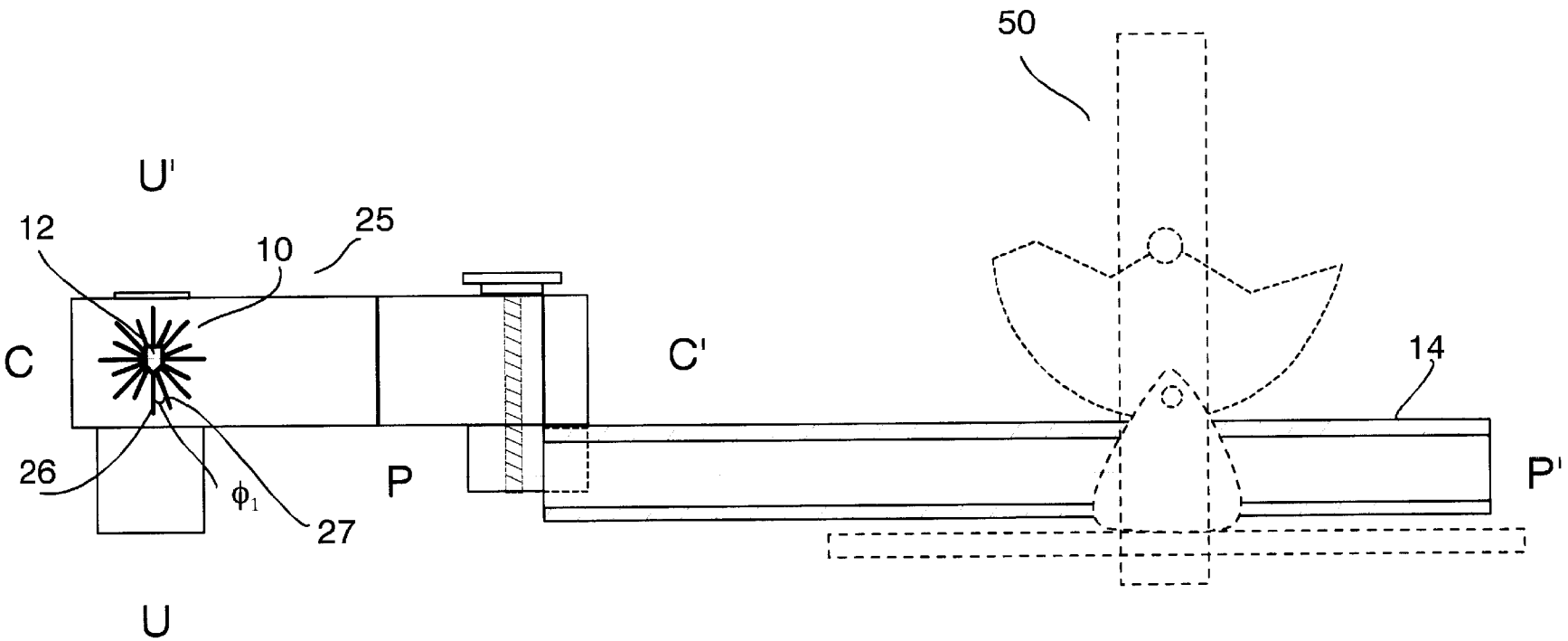
FIG. 4*a* shows the complete guide of the Preferred Embodiment of the present invention attached to a pipe segment and aligned for a first bend of that segment to be made with a pipe-bender (shown in stylized form).

The bend-angle-and-bend-plane guide 1 of the present invention is shown in its Preferred Embodiment in FIG. 1. It consists of two main parts: a gauge section 2 and a mounting section 3. A mounting clamp 4 located at a proximal end 3*a* of the mounting section 3 provides the means by which the guide 1 is affixed to a pipe 14, the pipe to be bent (typically by use of a bending tool, such as is depicted in FIG. 4*a* by the stylized bending tool 50).

The mounting section 3 is displayed in more detail in FIG. 3*a* and FIG. 3*b,* which illustrate that the clamp 4 includes a removably attached outer jaw 19, a removably attached inner jaw 20, and a thumbscrew 24, the clamp-tightening means used in the Preferred Embodiment. This is illustrated best in FIG. 3*b,* which shows a cutaway piece of the pipe 14 clamped between an outer-jaw clamping surface 21 and an inner-jaw clamping surface 22. The outer-jaw clamping surface 21 is a concave cylindrical surface having a radius of curvature r equal to that of the outside of the pipe 14. Similarly, the inner-jaw clamping surface 22 is a convex cylindrical surface having a radius r' equal to that of the inside of the pipe 14. To attach the mounting section 3 of the guide 1 to the pipe 14, the end of the pipe 14 is slipped into a space between the inner jaw 20 and the outer jaw 19, the connection between which has been loosened by loosening (unscrewing) the thumbscrew 24. Once the end of the pipe 14 is so inserted, the thumbscrew 24 is tightened so as to draw the outer-jaw 19 and the inner jaw 20 closer together and hence to bind the pipe 14 between the form-fitting outer-jaw clamping surface 21 and the inner-jaw clamping surface 22. The Preferred Embodiment of the guide 1 includes a set containing one or more sets of clamp jaws designed to fit the different sizes and different types of pipe with which the guide 1 may be used. In particular, each set includes several removably attachable pairs of outer jaws and inner jaws sized to fit common pipe sizes in a particular field and for a particular type of pipe, including but not limited to rigid pipe, EMT pipe, and IMC pipe. In the Preferred Embodiment, the outer jaw 19 is held to the rest of the mounting section 3 by means of detent pins 23, as shown in FIG. 3*a* and FIG. 3*b*. To change outer jaws, one simply pulls the present one off the detent pins 23 and presses the next one on. For changing inner jaws, one simply loosens thumbscrew 24 until the inner jaw 19 is completely unscrewed, after which one screws on the new inner jaw. The clamping means depicted here relates only to the Preferred Embodiment of the invention and is not intended to limit the scope of the invention. Subject to the requirement that the longitudinal axis of the guide 1 be parallel to the longitudinal axis of the pipe 14 when the former is mounted on the latter, a variety of mounting means can be substituted for the one used in the Preferred Embodiment.

Figure 4B:
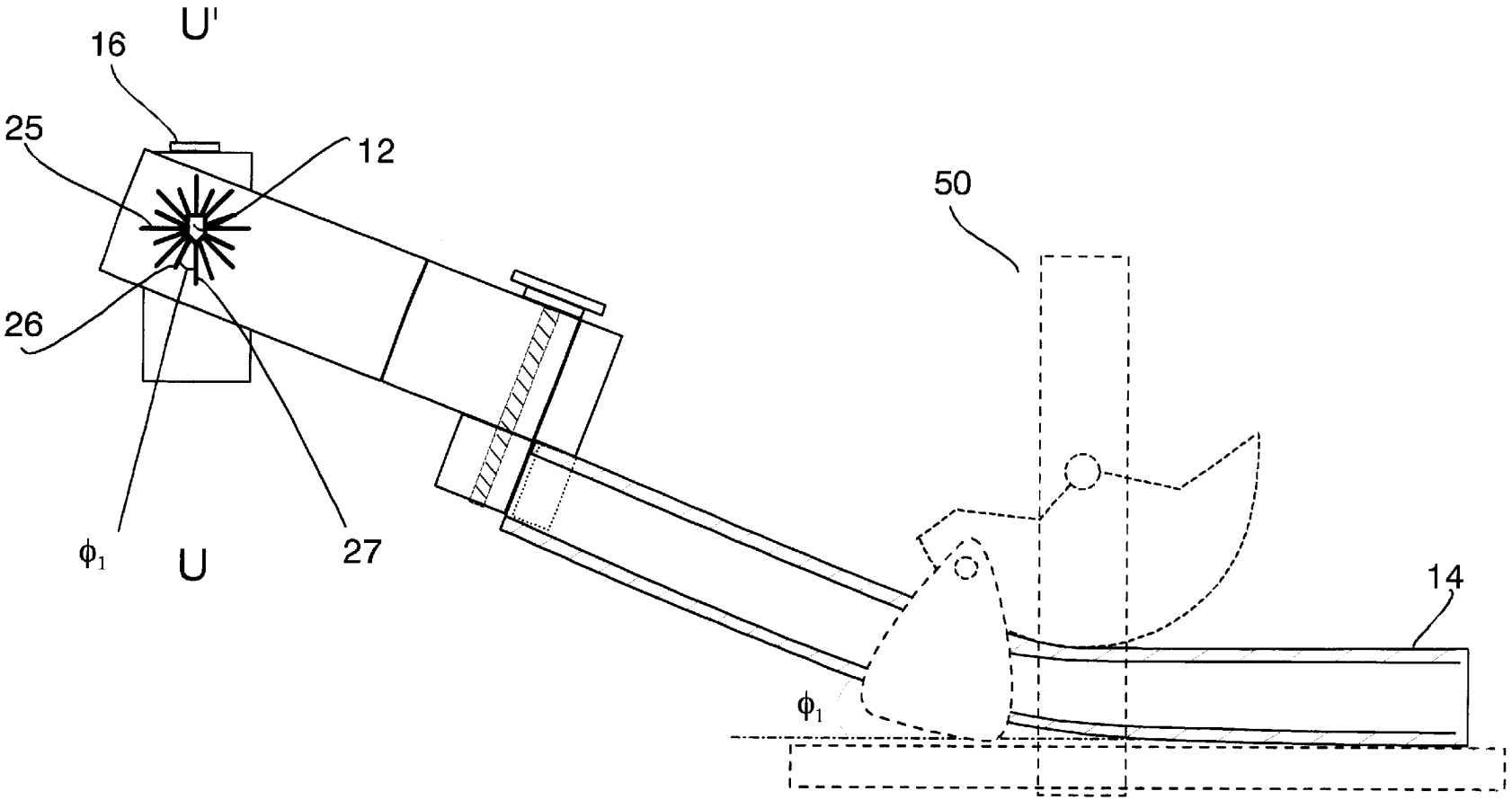
FIG. 4*b* shows the guide still mounted on the pipe segment after the first bend has been executed.
Figure 4C:
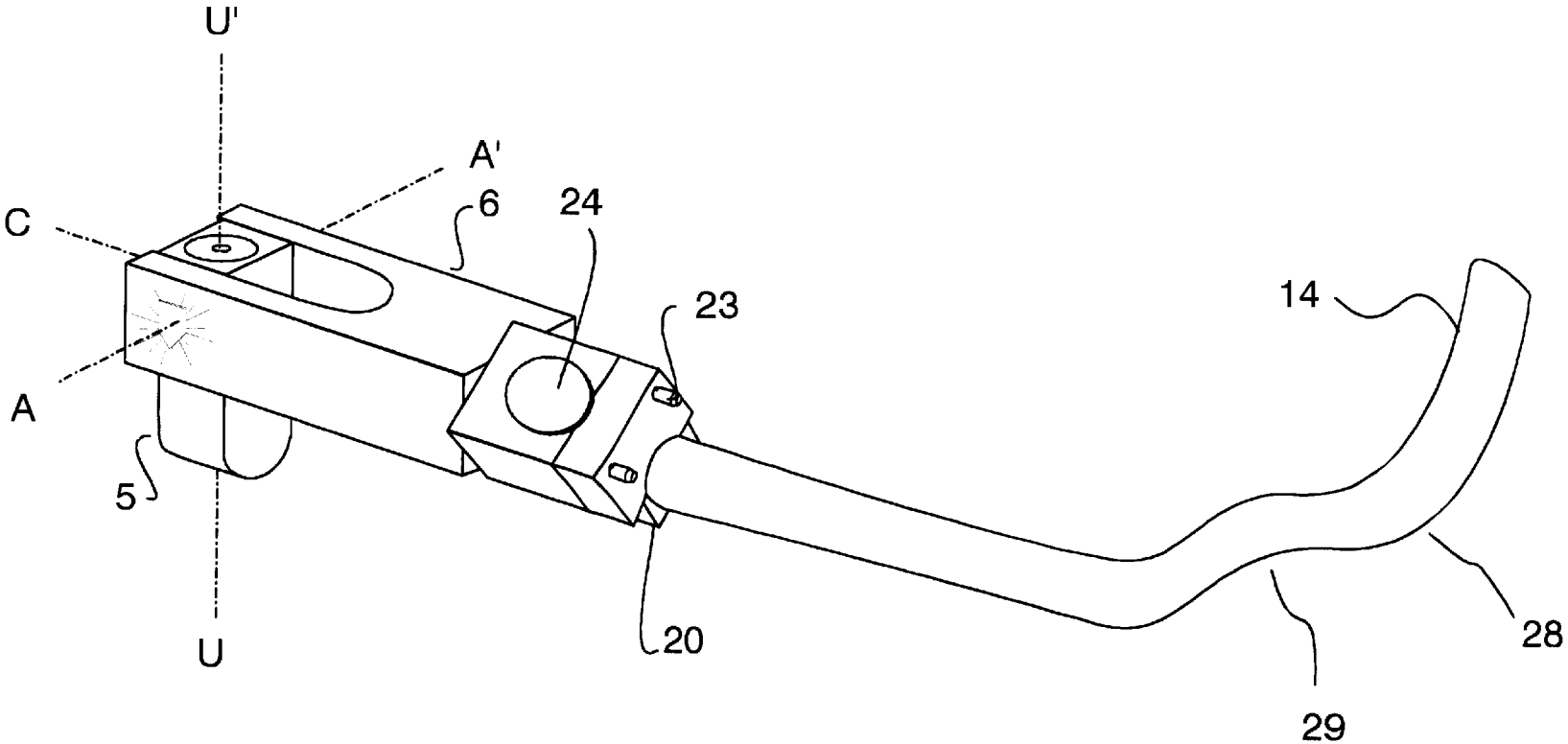
FIG. 4*c* shows the guide after its gauge section has been rotated for a bend that will be out of the plane defined by the two bends already present in the pipe as shown. The mounting section remains in the same position on the pipe as it had during the previous two bends.

The gauge section 2 is ratchedly-rotatably attached to a second end 3*b* of the mounting section 3. By this it is meant that one can rotate the gauge section 2 with respect to the mounting section 3 about their common longitudinal axis but that there are a number of stable positions in which the two sections have well-defined rotational positioning with respect to one another. In the Preferred Embodiment, these stable positions are 45° apart. In FIG. 1, FIG. 4*a,* and FIG. 4*b* the gauge section 2 and the mounting section 3 are shown with their respective outer walls parallel to one another; this corresponds to one of the stable positions. FIG. 4*c* depicts the guide 1 in a configuration where the gauge section 2 has been rotated 45° with respect to the mounting section 3. This is another of the stable positions for the two sections. In the Preferred Embodiment of the present invention, the coupling between the gauge section 2 and the mounting section 3 is accomplished by a spring (not shown) that lies along the common axis of the two sections and extendably holds the two sections together; the stable orientations are effected by the use of male fittings on the one section and conjugate female fittings on the other, both fittings deployed at the interface between the two sections and symmetrically located around the common longitudinal axis of the two sections. Although the stable positions in the Preferred Embodiment are spaced in increments of 45°, the means of establishing these stable positions in the Preferred Embodiment can be modified to make much smaller, or larger, increments, e.g., of 30°, 20°, 5°, 60°.

Figure 2:
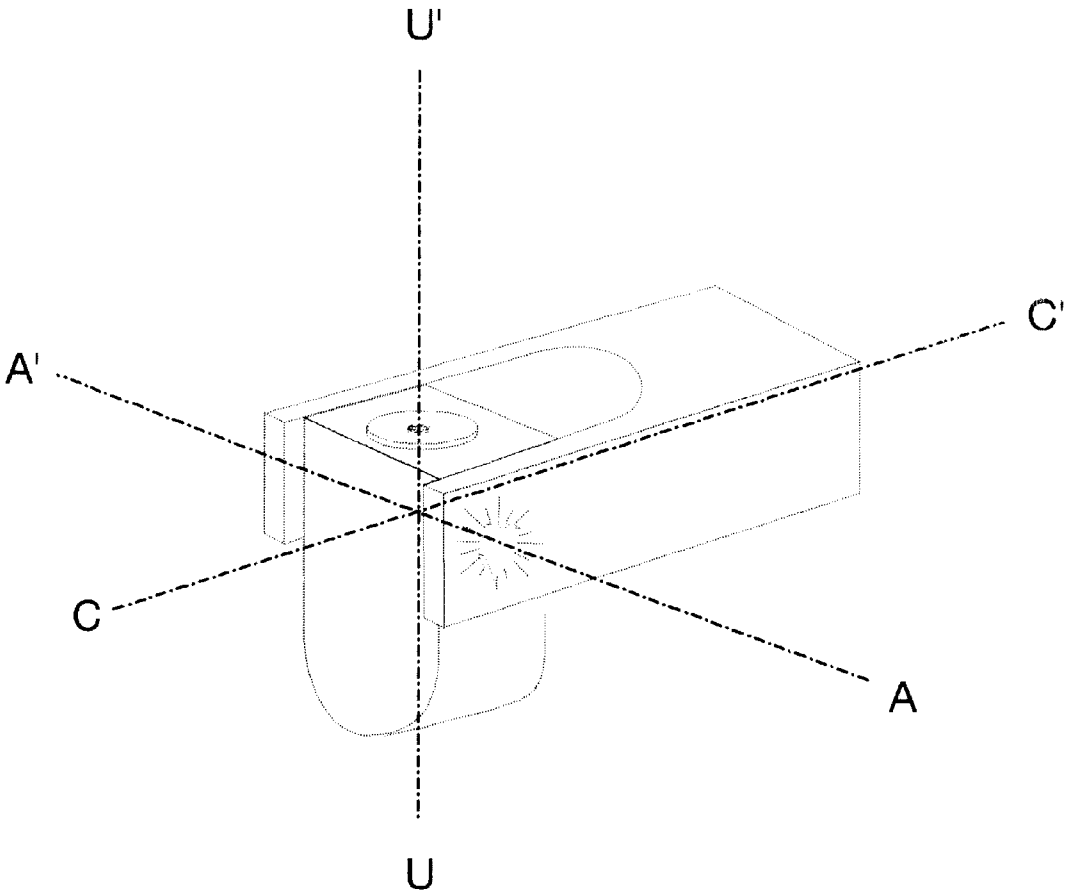
FIG. 2 is an illustration of the axes—A–A', C–C', and U–U'—that pass through the center of the plumb mount of the gauge section.

As shown in FIG. 1 and other figures, the gauge section 2 terminates in a forked plumb mount 6. A plumb arm 5 is pivotably suspended on a mounting pin 9 that runs between a left tine 7 and a right tine 8 of the forked plumb mount 6, so that the mounting pin 9 serves as an axis about which the plumb arm 5 can pivot freely through 360°. Certain key axes associated with the guide 1 and its operation are depicted in FIG. 2, which depicts the gauge section 2 by itself. The mounting pin 9 runs along a plumb-mounting-axis A–A', which intersects the guide-longitudinal-axis C–C'. Also intersecting the mounting pin 9 at its midpoint is plumb-axis U–U'. It can be seen that when the guide 1 is clamped onto the pipe 14, the guide-longitudinal-axis C–C' is parallel to an end-segment-longitudinal-axis P–P', shown in FIG. 4*a*.

Figure 5B:
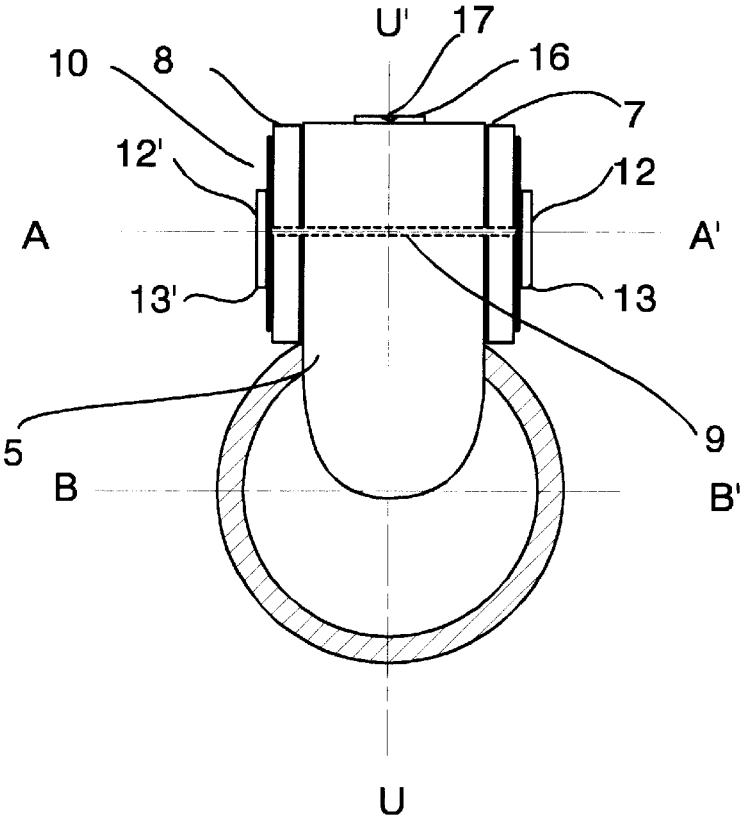
FIG. 5*b* is a view along the longitudinal axis of the pipe, looking toward the gauge section; this shows the plumb arm and the left and right tines of the mounting fork.
Figure 5A:
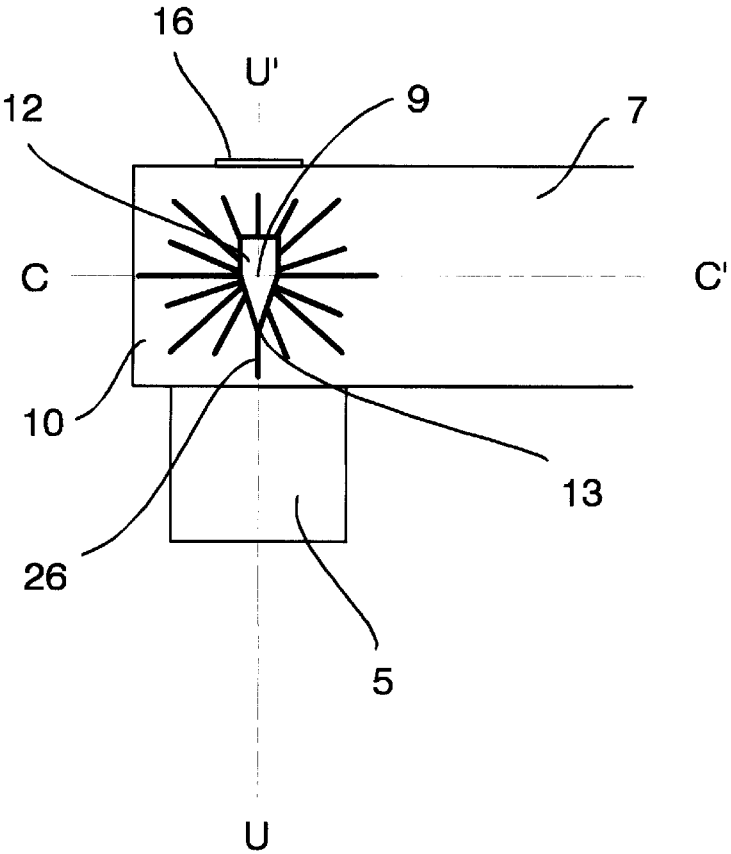
FIG. 5*a* is a side view of the gauge section, showing the plumb arm and the degree-of-rotation pointer and the degree-of-bend scale on a tine of the mounting fork.

As illustrated in FIG. 2, FIG. 5*a* and FIG. 5*b* the plumb-axis U–U' lies along the long axis of the plumb arm 5, intersecting the plumb-mounting axis A–A' and the guide-longitudinal-axis C–C' at the midpoint of the mounting pin 9. The free movement of the plumb arm 5 ensures that the plumb axis U–U' will always be vertical. It can be seen that the plumb-axis U–U' will always intersect the end-segment-longitudinal-axis P–P' and that once the bending of the pipe has begun, the associated bend-plane will be defined by these two axes; furthermore, even before the bending begins, once the guide 1 has been mounted on the pipe 14 and configured for a bend, the plumb-axis U–U' and the end-segment-longitudinal-axis P–P', then perpendicular to one another, will determine the position and orientation of the bend-plane about to be introduced.

In the Preferred Embodiment, a left degree-of-rotation pointer 12 is affixed to a left end of the mounting pin 9 outside of the left tine 7 of the mounting fork 6 (all as shown in FIG. 5*a*). Similarly, a right degree-of-rotation pointer 12' (indicated in FIG. *b*) is affixed to a right end of the mounting pin 9 outside of the right tine 8. The left degree-of-rotation pointer 12 is rigidly aligned with the plumb-axis U–U' of the plumb arm 5 and pivots around the plumb-mounting axis A–A' in alignment with the bend-angle-indicating plumb arm 5. It can be seen from this that the left degree-of-rotation pointer rotates as the pipe 14 is bent. A left degree-of-bend scale 10 circumscribes the left degree-of-rotation pointer 12 (and a right degree-of-bend scale 10' circumscribes the right degree-of-rotation pointer 12'). The point 13 of the left degree-of-rotation pointer 12 reads on the left degree-of-bend scale 10 so as to dynamically indicate the bend-rotation angle $\phi$ while the pipe 14 is being bent, all as shown in FIG. 4*b*.

As can be seen in FIG. 1 and FIGS. 5*a* and 5*b,* and elsewhere, an upper surface 15 of the plumb arm 5 lies in a plane orthogonal to the plumb axis U–U'. In the Preferred Embodiment of the present invention, a circular 360° spirit level 16 incorporating a bubble 17 is affixed to the upper surface 15 such that the upper surface 15 is parallel to the spirit level 16 and the plumb axis U–U' passes through a center of the spirit level 16.

The spirit level 16 is used first to establish a reference orientation for the guide 1 as it is mounted on the pipe 14 to be bent. With the bending-tool 50 affixed to the pipe 14 in preparation for bending the pipe 14 in the vertical plane, it is essential that the guide 1 be mounted on the pipe 14 such that the upper surface 15 is horizontal, i.e., that the bubble 17 remains in the center of spirit level 16 (a null indication). By monitoring the spirit level 16 during the bending operation and ensuring that it continues to give a null indication, one ensures that the bend-plane remains vertical.

Alternatively, in place of the spirit level of the Preferred Embodiment of the present invention, a circular compass-like instrument having a pointer and a degree-of-rotation scale about its perimeter can be used. This instrument would indicate proper alignment with the U–U' plane and the A–A' plane, similar to the spirit level, but would also indicate a degree of deflection from the C–C' axis to enable a bend operator to introduce a compound angle into a workpiece if so desired.

The application of the guide 1 of the present invention will now be examined in more detail, including those steps needed to introduce a bend that is deliberately "out-of-plane" by a fixed angle. First, the mounting section 3 is affixed to the end of the pipe 14 to be bent, as shown in FIG. 4*a*. As required, the bending-tool 50 is manipulated about the pipe 14 to prepare the pipe 14 to be bent in a vertical plane. Next, the guide 1, loosely mounted to the end of the pipe 14, is manipulated so as to ensure that the spirit level 16 is horizontal, and, consequently, the plumb-axis U–U' vertical. Alternatively, the guide 1 is firmly mounted to the end of the pipe 14 and pipe 14 manipulated so as to ensure that the spirit level 16 is horizontal. (Although the plumb-axis U–U' will always be vertical providing that the top surface 15 is horizontal, it is possible to have the guide-longitudinal-axis C–C' parallel to the pipe-segment-longitudinal axis P–P' and not have the top surface 15 horizontal, in which case the plumb-axis U–U' will not hang vertically. It is for this reason that the spirit level 16 is a 360° level.) With the pipe 14, bend-tool 50 and guide 1 all connected and oriented as described above, the operator is ready to make a first desired bend in the first bend-plane 25 (lying in the plane of the paper containing FIG. 4*b* and, in the shop, in a vertical plane). With reference to the scale 10, the operator first notes the starting mark 26 (typically 0°, with the orientations as specified) that the left pointer 12 is pointing to, then selects as a first target mark 27 differing from the starting mark 26 by an angle equal to the first desired bend-angle $\Phi_1$, then introduces into the pipe segment 14 an increasing bend, until the first target mark 27 comes under the left degree-of-rotation pointer 12. At that point the first desired bend has been made in the pipe 14 in the initial bend-plane 25.

To make a second desired bend 29 (and, by extension, all subsequent bends) in the initial bend-plane 25, the bend-tool operator repositions the pipe 14 in the bend tool 50 without changing the position of the guide 1, which is still clamped to the end of the pipe 14 from the first bend operation. The operator slides the pipe 14 through the bend tool 50 so as to locate it closer to the end of the pipe 14. He or she also re-orients the pipe 14 so that the spirit level 16 returns to a null position, that is, to a horizontal position, and the left pointer 12 returns to a vertical position, as indicated by the fact that it is pointing again at the starting mark 26. The operator then selects a new target mark 27' that is offset from the starting mark 26 by an angle equal to the second desired bend-angle $\Phi_2$ (it may for example, be equal in magnitude to $\Phi_1$, but with the opposite sense, as when one is introducing an offset into the pipe). The pipe 14 is then bent as was done in introducing the first bend. This ensures that the second bend is in the same plane as the first bend, and thus for all subsequent bends that are desired to be co-planar with the first.

In the alternative, consider that a third bend (by an angle $\Phi_3$) is to be made in a different plane from the first bend, and in particular that the second bend is to be "dogged" by a specific angle $\Theta_1$ out of the plane defined by the previous bend or bends. The operator proceeds as before, moving the bend-tool 50 to the location of the new bend and orienting the pipe 14 so that the spirit level 16 is horizontal. At that point, the operator rotates the gauge section 2 of the guide 1 with respect to the mounting section 3, as described above, by an angle-$\Theta_1$. (It is assumed that rotation by the angle-$\Theta_1$ brings the gauge section 2 and mounting section 3 back to one of the stable positions described above.) A rotated guide 1 is shown in FIG. 4*c*. The operator then rotates the pipe 14 until the spirit level 16 gives a null reading, i.e., is in a horizontal plane. From there, the bend-tool operator introduces the bend by an angle $\Phi_3$ just as the first two bends were introduced, as illustrated in FIG. 4*a* and FIG. 4*c*. Subsequently, any number of additional bends in the same, newly established bend-plane may be made without dogging, simply by re-aligning the pipe to obtain a level condition as indicated by bend-plane level 16 before bending, as described above. In summary, through use of the guide 1, each successive bend can be placed in the bend-plane defined by the previous bend, or it can be placed in a different plane.

What is claimed is:

1. An alignment device for assistance in bending a pipe having an end segment with a longitudinal axis at one or more pre-determined angles and in one or more pre-determined planes, the device comprising:

a mounting section, said mounting section being securely attachable to the end segment, wherein a longitudinal axis of said mounting section defines a longitudinal guide axis of the device that is parallel to a longitudinal axis of the end segment, a gauge section rotatably coupled to and co-axial with said mounting section, said gauge section including a plumb arm pivotably suspended on a plumb mounting pin distal to said mounting section, wherein a longitudinal axis of said plumb arm defines a plumb axis and a longitudinal axis of said plumb mounting pin defines a plumb-mounting axis, and means to observe and determine angular movement of the pipe in a third plane so as to enable bending and measurement of the pipe at compound angles, wherein said longitudinal guide axis, said plumb axis and said plumb-mounting axis intersect one another and are orthogonal with respect to one another, thereby defining three degrees of rotation of the device to enable bending of the pipe at one or more angles in one or more bend planes.

2. The device of claim 1 wherein said gauge section further includes a pointer coupled to said mounting pin for rotation therewith and an inscribed angle scale adjacent to said pointer, wherein said plumb arm is pivotable with respect to an orientation of said mounting section, and wherein said pointer in combination with said inscribed angle displays an orientation angle of said plumb arm with respect to a reference orientation of the pipe.

3. The device of claim 2 wherein said means to observe and determine angular movement of the pipe in a third plane includes a 360° vial level positioned on an upper end of said plumb arm, said upper end being flat and orthogonal to said plumb axis of said plumb arm and wherein said vial level gives a null reading when said plumb axis is vertical, at which time said upper end is horizontal.

4. The device of claim 3 further comprising a degree scale mounted on said upper end of said plumb arm around a perimeter of said 360° spirit level.

5. The device of claim 4 wherein said gauge section is rotatably attached to said mounting section by a ratchet means.

6. The device of claim 5 wherein said mounting section further comprises an inner clamping jaw, an outer clamping jaw, and a means for securely clamping said inner clamping jaw against an inner pipe surface and said outer clamping jaw against an outer pipe surface.

7. The device of claim 6 wherein said inner clamping jaw has a convex cylindrical surface with a inner-jaw radius of curvature equal to that of said inner pipe surface and wherein said outer clamping jaw has a concave cylindrical surface with an outer-jaw radius of curvature equal to that of said outer pipe surface.

8. The device of claim 7 wherein said ratchet means includes: (a) an axial spring connection pulling said gauge section against said mounting section at a gauge-section/mounting-section interface, said interface being between a distal end of said mounting section and a proximal end of said gauge section; (b) a series of discrete male connectors deployed on said distal end of said mounting section, wherein said series of male connectors forms a ring about said longitudinal axis of said device; and (c) a series of female connectors deployed on said proximal end of said gauge device, where said female connectors are conjugate to said male connectors.

9. The device of claim 8 wherein said male connectors and said female connectors are deployed in such manner that said stable gauge-section orientations occur at 45°-intervals as said gauge section is rotated with respect to said mounting section.

10. A kit comprising the device of claim 9 and a set of inner jaws and outer jaws sized to fit a variety of pipes.

11. The device of claim 3 wherein said plumb arm further comprises a compass, said compass mounted in a compass mount on an upper end of said plumb arm, said upper end being flat and orthogonal to said plumb axis, said compass having a pointer and being freely movable in said compass mount.

12. An alignment device for assistance in bending a pipe having an end segment with a longitudinal axis at one or more pre-determined angles and in one or more pre-determined planes, the device comprising:

a mounting section;

means for securely attaching said mounting section to said end segment, wherein said mounting section defines a first axis that is parallel to said longitudinal axis of said end segment when attached to said end segment;

a gauge section rotatably coupled to said mounting section such that said gauge section rotates relative to said mounting section about said first axis;

a plumb arm suspended on said gauge section to freely pivot relative to said gauge section about a second axis, said second axis being orthogonal to said first axis; and a spirit level disposed on said plumb arm.

* * * * *